US006184505B1

(12) United States Patent
Jones

(10) Patent No.: US 6,184,505 B1
(45) Date of Patent: Feb. 6, 2001

(54) GAUGE ASSEMBLY FOR HOLDING HEATER WIRE

(75) Inventor: Thaddeus M. Jones, Bremen, IN (US)

(73) Assignee: MSX, Inc., South Bend, IN (US)

( * ) Notice: Under 35 U.S.C. 154(b), the term of this patent shall be extended for 0 days.

(21) Appl. No.: 09/541,791

(22) Filed: Apr. 3, 2000

(51) Int. Cl.[7] ..... H05B 3/06
(52) U.S. Cl. ..... 219/520; 219/213; 219/453.12
(58) Field of Search ..... 219/520, 524, 219/525, 532, 536, 200, 201, 451.1, 453.11, 453.12, 453.13, 453.14, 453.15, 454.11, 546, 548, 549

(56) References Cited

U.S. PATENT DOCUMENTS 2,672,545 * 3/1954 Alderman et al. ..... 219/453.12

* cited by examiner

*Primary Examiner*—Tu Ba Hoang
(74) *Attorney, Agent, or Firm*—Taylor & Aust, P.C.

(57) ABSTRACT

A gauge assembly holds heater wire adjacent to a surface to be heated. The assembly includes a plurality of elongate elements, with each elongate element having two opposite ends. Each opposite end is pivotably connected to a corresponding opposite end of an adjacent elongate element. At least one of the elongate elements retains at least one corresponding portion of the heater wire.

22 Claims, 2 Drawing Sheets

GAUGE ASSEMBLY FOR HOLDING HEATER WIRE

BACKGROUND OF THE INVENTION

1. Field of the Invention

The present invention relates to gauge assemblies, and, more particularly, to gauge assemblies for holding heater wire.

2. Description of the Related Art

A gauge can be used to hold a heater wire in place adjacent to a surface that is to be heated by the wire. For example, a gauge which is supported by a ground surface or subsurface can be used to hold a heater wire just below the upper surface of a floor that is to be formed around the heater wire.

It is known for the gauge to be formed of strips of sheet metal which are cut to length by the user depending on the dimensions of the floor to be heated. The gauge strips may be formed of steel, for example. Two different strips of the steel gauge are placed on opposite sides of the floor, and the heater wire is intertwined between hooks on the gauge strips, thereby forming a zig-zagging or serpentine pattern.

Two linear strips of steel gauge can be arranged such that heater wire held thereby substantially covers a floor having four linear sides or boundaries. However, with a floor having stepped or curved boundaries, it is not possible to arrange two linear strips of steel gauge such that all areas of the floor can be substantially covered by the heater wire held thereby. That is, there will be outer sections of the floor that must be left unheated by the heater wire. Another problem is that cutting strips of steel gauge to length is a fairly difficult and time consuming procedure.

The hooks that hold the heater wire are created by cutting through the strip of sheet metal to form three sides of a rectangle. The rectangle is then pushed out of the plane of the metal strip to form a hook, with the fourth, uncut side of the rectangle still being attached to the metal strip. A problem is that the three cut edges of the hook are sharp, and it is known for these sharp edges to cut through the outer layer of insulation of a heater wire hooked thereon.

What is needed in the art is a gauge device that enables the heater wire held thereby to cover substantially all of an irregularly-shaped floor surface. What is also needed is a gauge device that does not need to be cut to length.

SUMMARY OF THE INVENTION

The present invention provides a gauge device formed of pivotably and detachably connected sections which allow the gauge device to conform to nonlinearities in the boundaries of the floor surface.

The invention comprises in one form thereof, a gauge assembly for holding heater wire adjacent to a surface to be heated. The assembly includes a plurality of elongate elements, with each elongate element having two opposite ends. Each opposite end is pivotably connected to a corresponding opposite end of an adjacent elongate element. At least one of the elongate elements retains at least one corresponding portion of the heater wire.

An advantage of the present invention is that the gauge assembly can quickly and easily be arranged such that the heater wire held thereby covers substantially all of an irregularly-shaped floor.

Another advantage is that a number of sections of the gauge assembly can be easily interconnected to achieve any desired length without the need for cutting.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Figure 1:
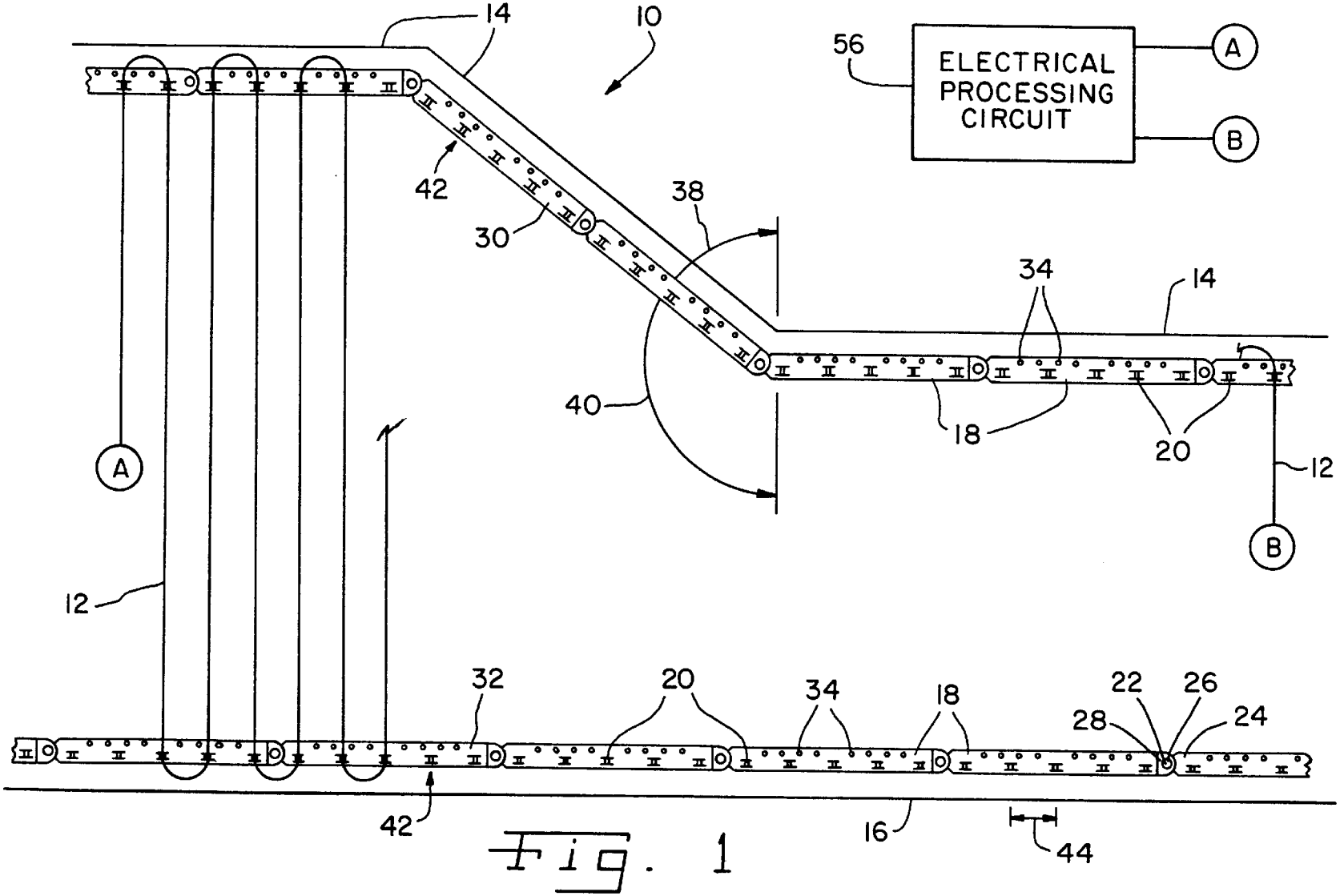
FIG. 1 is a top view of one embodiment of the gauge assembly of the present invention.

Corresponding reference characters indicate corresponding parts throughout the several views. The exemplifications set out herein illustrates one preferred embodiment of the invention, in one form, and such exemplifications are not to be construed as limiting the scope of the invention in any manner.

DETAILED DESCRIPTION OF THE INVENTION

Referring now to the drawings, and particularly to FIG. 1, there is shown one embodiment of a gauge assembly 10 holding a heater wire 12 between opposite boundaries 14 and 16 of a floor surface yet to be formed.

Figure 2:
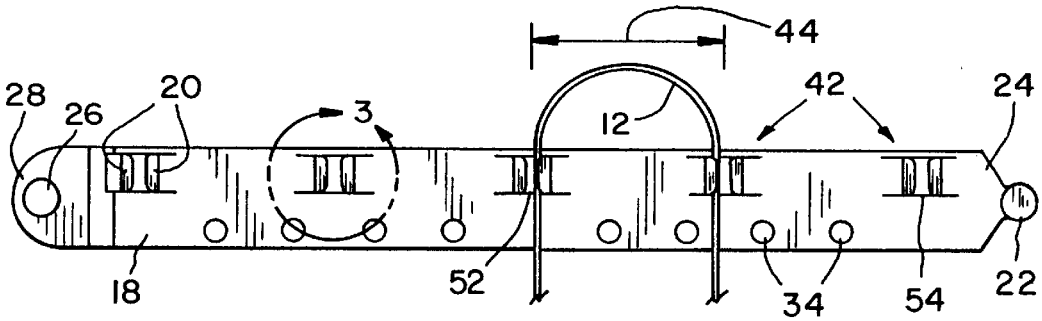
FIG. 2 is an enlarged, top view of one of the elongate elements of FIG. 1.
Figure 3:
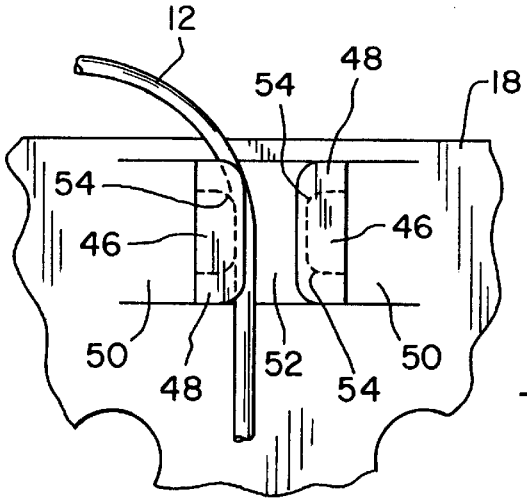
FIG. 3 is a further enlarged, top view of one of the pairs of posts of the elongate element of FIG. 2.
Figure 4:
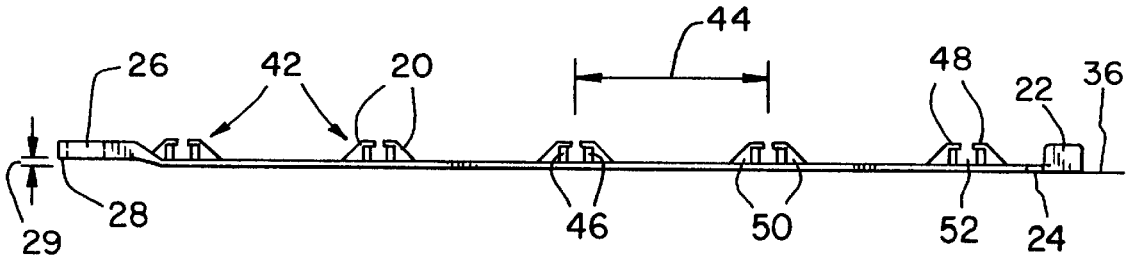
FIG. 4 is a side view of the elongate element of FIG. 2.

Gauge assembly 10 includes a plurality of interconnected elongate segments 18, with a plurality of pairs of retainment devices 20 being attached to each elongate segment 18. Each segment 18 includes a circular projection 22 (best seen in FIG. 2) at one end 24 and a circular recess 26 at the opposite end 28. Each projection 22 is pivotably received in the recess 26 of an adjacent segment 18, thereby interconnecting segments 18 end-to-end. As indicated at 29 in FIG. 4, the bottom surface of end 28 is elevated slightly above the bottom surface of end 24, thereby allowing an end 24 of an adjacent segment to slip underneath end 28. Elongate segments 18 are arranged in a first chain 30 adjacent and conforming to non-linear floor boundary 14, and in a second chain 32 adjacent and conforming to floor boundary 16. Each segment 18 includes a plurality of throughholes 34 through which a fastener, such as a screw or staple (not shown) may be inserted in order to secure segment 18 to a subsurface 36 (FIG. 4) below the surface to be heated.

Segments 18 are formed of an electrically nonconducting material, such as polycarbonate plastic, which is relatively strong, inexpensive, has good mechanical properties, and can be bent. Each segment 18 has an equal length between ends 24 and 28 of between 3 inches and 9 inches, and preferably between 4 inches and 6 inches. Because of this relatively small length as compared to the length of a floor surface to be heated, a number of segments 18 can be joined together such that their total length is approximately equal to the length of the floor surface to be heated. Thus, there is no need to cut away any length of any of segments 18.

As indicated by arrows 38 and 40, due to the pivotable interconnections between projections 22 and recesses 26, it is possible to pivot each segment 18 over a 180° range relative to an adjacent segment 18. The pivoting occurs in a plane parallel to the surface to be heated. This pivotability enables chain 30 to be arranged to conform to and follow the curves and angles of a nonlinear floor boundary, such as boundary 14.

Retainment devices 20 are arranged in pairs 42 along the length of each segment 18. There is a constant distance 44 of approximately one inch between adjacent pairs of retainment devices 20. Each retainment device 20 includes a post 46, a cap 48 and a supporting wedge 50. A pair 42 of retainment devices 20 define a groove 52 therebetween. Each post 46 includes two radii 54 for engaging heater wire 12.

In use, a user threads heater wire 12 into grooves 52 between a pair 42 of retainment devices 20. Heater wire 12 is wound back and forth between chains 30 and 32 in a serpentine or zig-zagging path, as partially shown in FIG. 1, substantially covering the entire area of the floor to be heated. Radii 54 allow posts 46 to support and retain heater wire 12 without piercing the outer layer of insulation on heater wire 12. Caps 48 extend beyond the outer edge of their respective posts 46, thereby preventing heater wire 12 from slipping off of and out of contact with posts 46.

An electrical processing circuit 56 is connected to the two opposite ends of heater wire 12. After a floor has been formed over gauge assembly 10 and heater wire 12, electrical processing circuit 56 applies electrical power to heater wire 12 in order to heat the floor.

Elongate segments 18 have been described as being nailed, stapled, or otherwise fastened to subsurface 36. However, it is to be understood that it is also possible to adhere segments 18 to subsurface 36 using contact cement, for example. The contact cement may be applied to a bottom surface of segments 18 and covered with tape, which may then be peeled off immediately before segments 18 are applied to subsurface 36.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A gauge assembly for holding heater wire adjacent to a surface to be heated, said assembly comprising a plurality of elongate elements, each said elongate element having two opposite ends, each said opposite end being configured for being pivotably connected to a corresponding said opposite end of an adjacent said elongate element, at least one of said elongate elements being configured for retaining at least one corresponding portion of the heater wire so that the heater wire is winding in a sepertine path between said elongate elements.

2. The gauge assembly of claim 1, wherein each of said opposite ends has one of a recess and a projection, each said projection being configured for being pivotably retained in a corresponding said recess of an adjacent said elongate element such that said elongate elements can be interconnected end-to-end.

3. The gauge assembly of claim 1, wherein a first of said opposite ends has a recess, a second of said opposite ends having a projection, each said projection being configured for being pivotably retained in a corresponding said recess of an adjacent said elongate element such that said elongate elements can be interconnected end-to-end.

4. The gauge assembly of claim 3, wherein each of said recess and said projection is substantially circular.

5. The gauge assembly of claim 3, wherein a bottom surface of said first opposite end is elevated above a bottom surface of said second opposite end.

6. The gauge assembly of claim 1, wherein each said opposite end is configured for being detachably connected to said corresponding opposite end of said adjacent elongate element.

7. The gauge assembly of claim 1, wherein adjacent said elongate elements define a pivot angle therebetween, said pivot angle being adjustable.

8. The gauge assembly of claim 7, wherein said pivot angle has a range of greater than 60°.

9. The gauge assembly of claim 1, wherein said at least one elongate element includes at least one of a post and a groove configured for retaining the at least one corresponding portion of the heater wire.

10. The gauge assembly of claim 1, wherein said at least one elongate element includes at least one post having a radius configured for engaging and retaining the at least one corresponding portion of the heater wire.

11. The gauge assembly of claim 1, wherein said at least one elongate element includes at least one pair of adjacent posts configured for receiving the at least one corresponding portion of the heater wire therebetween, each said post having a radius configured for engaging the at least one corresponding portion of the heater wire.

12. The gauge assembly of claim 1, wherein said at least one elongate element includes at least one throughhole configured for receiving a fastening device.

13. The gauge assembly of claim 1, wherein each said elongate element has a length between said opposite ends, each said length being approximately between 3 inches and 9 inches.

14. The gauge assembly of claim 1, wherein each said elongate element has an approximately equal length between said opposite ends, each said approximately equal length being approximately between 4 inches and 6 inches.

15. The gauge assembly of claim 1, wherein each said elongate element is formed of a plastic material.

16. A method of heating a surface having a nonlinear boundary, said method comprising the steps of:

providing a plurality of elongate elements, said elongate elements including retainment devices for retaining corresponding portions of heater wire;

pivotably interconnecting first ones of said elongate elements end-to-end substantially along and adjacent to the nonlinear boundary of the surface;

adjusting pivot angles between adjacent ones of said first elongate elements such that said interconnected first elongate elements substantially conform to and follow the nonlinear boundary of the surface;

interconnecting second ones of said elongate elements end-to-end substantially in opposition to said first elongate elements;

winding heater wire in a serpentine path between said retainment devices of said first elongate elements and said retainment devices of said second elongate elements; and applying electrical power to said heater wire.

17. The method of claim 16, wherein said each said retainment device comprises a post, said winding step including wrapping the heater wire around said posts.

18. The method of claim 17, wherein said winding step includes threading the heater wire between two adjacent said posts.

19. The method of claim 16, comprising the further step of fastening said elongate elements to a subsurface.

20. The method of claim 16, wherein each of said pivot angles is substantially parallel to the surface.

21. A heater assembly for heating a surface, said heater assembly comprising:

a heater wire; and a gauge assembly including a plurality of elongate elements, at least one of said elongate elements being configured for holding said heater wire in a serpentine path between said elongate elements and adjacent to the surface to be heated, each said elongate element having two opposite ends, each said opposite end being configured for being pivotably connected to a corresponding said opposite end of an adjacent said elongate element.

22. The heater assembly of claim 21, further comprising an electrical processing circuit connected to said heater wire.

* * * * *